US008853928B2

(12) United States Patent
Tanaka et al.

(10) Patent No.: US 8,853,928 B2
(45) **Date of Patent: *Oct. 7, 2014**

(54) SPARK PLUG ELECTRODE, METHOD FOR PRODUCING SAME, SPARK PLUG, AND METHOD FOR PRODUCING SPARK PLUG

(75) Inventors: Tomo-o Tanaka, Kitanagoya (JP); Tsutomu Shibata, Owariasahi (JP); Takaaki Kikai, Ama (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/824,058

(22) PCT Filed: Aug. 24, 2011

(86) PCT No.: PCT/JP2011/069076

§ 371 (c)(1), (2), (4) Date: Mar. 15, 2013

(87) PCT Pub. No.: WO2012/039228

PCT Pub. Date: Mar. 29, 2012

(65) Prior Publication Data

US 2013/0181596 A1 Jul. 18, 2013

(30) Foreign Application Priority Data

Sep. 24, 2010 (JP) ..... 2010-213830

(51) Int. Cl.

| | |
|---|---|
| ***H01T 13/39*** | (2006.01) |
| ***C22C 19/03*** | (2006.01) |
| ***C22C 49/08*** | (2006.01) |
| ***H01T 13/16*** | (2006.01) |
| ***H01T 21/02*** | (2006.01) |
| ***C22C 26/00*** | (2006.01) |
| ***C22C 32/00*** | (2006.01) |
| ***C22C 19/05*** | (2006.01) |

(52) U.S. Cl.

CPC ..... *H01T 13/39* (2013.01); *C22C 19/03* (2013.01); *C22C 49/08* (2013.01); *H01T 13/16* (2013.01); *H01T 21/02* (2013.01); *C22C 26/00* (2013.01); *C22C 32/0084* (2013.01); *C22C 2026/002* (2013.01); *C22C 19/058* (2013.01)

USPC ..... 313/141; 313/118; 445/7

(58) Field of Classification Search

CPC ..... H01T 13/39; H01T 21/00; H01T 21/02; C22C 32/0021; C22C 32/0084; C22C 49/02; C22C 49/14; C22C 9/00

USPC ..... 313/141; 445/7

See application file for complete search history.

(56) References Cited

U.S. PATENT DOCUMENTS

| | | | |
|---|---|---|---|
| 5,578,894 | A | 11/1996 | Oshima |
| 6,121,719 | A | 9/2000 | Matsutani et al. |

(Continued)

FOREIGN PATENT DOCUMENTS

| | | | |
|---|---|---|---|
| CN | 101043125 | A | 9/2007 |
| JP | 02-295085 | A | 12/1990 |

(Continued)

OTHER PUBLICATIONS

International Search Report mailed Nov. 29, 2011 for the corresponding PCT Application No. PCT/JP2011/069076.

(Continued)

*Primary Examiner* — Sikha Roy

(74) *Attorney, Agent, or Firm* — Leason Ellis LLP.

(57) ABSTRACT

A spark plug includes at least one of a center electrode or a ground electrode that is produced by the steps of: mixing a matrix metal with carbon so that the carbon content of the resultant mixture is adjusted to 80 vol. % or less; subjecting the mixture to powder compacting or sintering, to thereby form a core; placing the core in a cup formed of nickel or a metal containing nickel as a main component; and subjecting the cup to cold working. The thus-produced electrode exhibits favorable thermal conductivity and good heat dissipation, by virtue of the small difference in thermal expansion coefficient between the core and an outer shell. The spark plug including the above electrode exhibits excellent durability.

15 Claims, 3 Drawing Sheets

(56) References Cited

U.S. PATENT DOCUMENTS

| | | | | |
|---|---|---|---|---|
| 8,072,125 | B2 | 12/2011 | Torii et al. | |
| 2007/0159046 | A1 | 7/2007 | Yoshimoto et al. | |
| 2007/0216275 | A1 | 9/2007 | Torii et al. | |
| 2013/0181597 | A1 * | 7/2013 | Tanaka et al. | 313/141 |

FOREIGN PATENT DOCUMENTS

| | | | |
|---|---|---|---|
| JP | 05-343157 | A | 12/1993 |
| JP | 07-037678 | A | 2/1995 |
| JP | 11-154584 | A | 6/1999 |
| JP | 2006-316343 | A | 11/2006 |
| JP | 2007-165291 | A | 6/2007 |
| JP | 2008-218249 | A | 9/2008 |

OTHER PUBLICATIONS

Office Action issued Feb. 26, 2014 for the corresponding Korean Application No. 10-2013-7010184.

Office Action mailed Jan. 13, 2014 for the corresponding Chinese Application No. 201180046169.5.

* cited by examiner

SPARK PLUG ELECTRODE, METHOD FOR PRODUCING SAME, SPARK PLUG, AND METHOD FOR PRODUCING SPARK PLUG

CROSS-REFERENCE TO RELATED PATENT APPLICATIONS

This application is a U.S. National Phase Application under 35 U.S.C. §371 of International Patent Application No. PCT/JP2011/069076, filed Aug. 24, 2011, and claims the benefit of Japanese Patent Application No. 2010-213830, filed Sep. 24, 2010, all of which are incorporated by reference herein. The International Application was published in Japanese on Mar. 29, 2012 as International Publication No. WO/2012/039228 under PCT Article 21(2).

FIELD OF THE INVENTION

The present invention relates to a spark plug electrode; a method for producing the electrode; a spark plug; and a method for producing the spark plug.

BACKGROUND OF THE INVENTION

With the progress of high-performance internal combustion engines, a center electrode or ground electrode of a spark plug for such an internal combustion engine tends to be used at higher temperatures. Since the material of such an electrode may be degraded through heat accumulation by combustion, the electrode is required to have high thermal conductivity for achieving good heat dissipation. Therefore, there has been proposed employment of an electrode including an outer shell formed of a nickel alloy exhibiting excellent corrosion resistance, and a core formed of a metal having a thermal conductivity higher than that of the nickel alloy <see, for example, Japanese Patent Application Laid-Open (kokai) No. H05-343157>.

Problems to be Solved by the Invention

Copper is preferably employed as a core material, by virtue of its high thermal conductivity. However, when an outer shell is formed of a nickel alloy, the difference in thermal expansion coefficient increases between the outer shell and the core, and thus clearances are formed at the boundary between the outer shell and the core due to thermal stress. Formation of such clearances at the boundary between the outer shell and the core may be prevented by decreasing the difference in thermal expansion coefficient between the outer shell and the core. In this case, the nickel alloy forming the outer shell plays a role in imparting corrosion resistance to the electrode, and thus the composition of the alloy cannot be greatly varied. Therefore, the thermal expansion coefficient of the core could be reduced by adding a metal (other than copper) to copper forming the core (i.e., the core material is alloyed). However, the thus-alloyed core material exhibits a thermal conductivity lower than that of copper alone, which is not preferred.

A conceivable approach for reducing the thermal expansion coefficient of the core is to disperse ceramic powder in the core. However, in this case, the thermal conductivity of the Core is lowered, and the ceramic powder, which exhibits high hardness, may cause a problem in that the service life of a working jig (e.g., a machining jig, a cutting jig, or a molding die) is shortened.

The core material employed may be, for example, nickel or iron, which has a thermal expansion coefficient similar to that of a nickel alloy and is less expensive than copper. However, the thermal conductivity of nickel or iron is lower than that of Cu.

In view of the foregoing, an object of the present invention is to provide a spark plug electrode including an outer shell formed of a nickel alloy, and a core, which electrode maintains good thermal conductivity, wherein the difference in thermal expansion coefficient between the outer shell and the core is small. Another object of the present invention is to provide a spark plug including the electrode and exhibiting excellent durability.

SUMMARY OF THE INVENTION

Means for Solving the Problems

In order to achieve the aforementioned objects, the present invention provides the following.

(1) A spark plug electrode serving as at least one of a center electrode and a ground electrode for a spark plug, the electrode being characterized by comprising a core formed of a composite material containing a matrix metal and carbon dispersed therein in an amount of 80 vol. % or less; and an outer shell which surrounds at least a portion of the core and which is formed of nickel or a metal containing nickel as a main component.

(2) A spark plug electrode according to (1) above, wherein the matrix metal is selected from among copper, iron, nickel, and an alloy containing, as a main component, at least one of copper, iron, and nickel.

(3) A spark plug electrode according to (1) or (2) above, wherein the carbon content of the composite material is 10 vol. % to 80 vol. %.

(4) A spark plug electrode according to any one of (1) to (3) above, wherein the carbon content of the composite material is 15 vol. % to 70 vol. %, and the composite material has a thermal expansion coefficient of $5\times10^{-6}$/K to $14\times10^{-6}$/K.

(5) A spark plug electrode according to any one of (1) to (4) above, wherein the carbon is at least one species selected from among carbon powder, carbon fiber, and carbon nanotube.

(6) A spark plug electrode according to (5) above, wherein the carbon powder has a mean particle size of 2 μm to 200 μm.

(7) A spark plug electrode according to (5) above, wherein the carbon fiber has a mean fiber length of 2 μm to 2,000 μm.

(8) A spark plug electrode according to (5) above, wherein a mean length of the carbon nanotube in the longitudinal direction is 0.1 μm to 2,000 μm.

(9) A spark plug comprising:

an insulator having an axial hole extending in a direction of an axis;

a center electrode held in the axial hole;

a metallic shell provided around the insulator; and a ground electrode which is provided such that a proximal end portion of the ground electrode is bonded to the metallic shell, and a gap is formed between a distal end portion of the ground electrode and a front end portion of the center electrode, characterized in that at least one of the center electrode and the ground electrode is an electrode as described above.

(10) A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method being characterized in that:

a step of producing at least one of the center electrode and the ground electrode includes mixing a matrix metal with carbon so that the carbon content of the resultant mixture is adjusted to 80 vol. % or less; subjecting the mixture to powder compacting or sintering, to thereby form a core; placing the core in a cup formed of nickel or a metal containing nickel as a main component; and subjecting the cup to cold working.

(11) A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method being characterized in that:

a step of producing at least one of the center electrode and the ground electrode includes preparing a calcined carbon product; impregnating the calcined carbon product with a molten matrix metal, to thereby form a core having a carbon content of 80 vol. % or less; placing the core in a cup formed of nickel or a metal containing nickel as a main component; and subjecting the cup to cold working.

(12) A method for producing at least one of a center electrode and a ground electrode for a spark plug, characterized by comprising mixing a matrix metal with carbon so that the carbon content of the resultant mixture is adjusted to 80 vol. % or less; subjecting the mixture to powder compacting or sintering, to thereby form a core; placing the core in a cup formed of nickel or a metal containing nickel as a main component; and subjecting the cup to cold working so as to achieve a specific shape.

(13) A method for producing at least one of a center electrode and a ground electrode for a spark plug, characterized by comprising preparing a calcined carbon product; impregnating the calcined carbon product with a molten matrix metal, to thereby form a core having a carbon content of 80 vol. % or less; placing the core in a cup formed of nickel or a metal containing nickel as a main component; and subjecting the cup to cold working so as to achieve a specific shape.

Effects of the Invention

According to the spark plug electrode of the present invention, by virtue of the small difference in thermal expansion coefficient between an outer shell formed of a nickel alloy and a core, formation of clearances can be prevented at the boundary between the outer shell and the core. In addition, since the core material is a composite material prepared by dispersing, in a matrix metal, carbon, which has a thermal conductivity several times higher than that of copper, the spark plug electrode exhibits good heat dissipation and thus excellent durability. Furthermore, the spark plug electrode exhibits favorable processability and thus applies a low load to a working jig.

Since the spark plug of the present invention includes an electrode exhibiting good heat dissipation, the spark plug exhibits excellent durability.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

The present invention will next be described by taking, as an example, a method for producing a center electrode.

Figure 1:
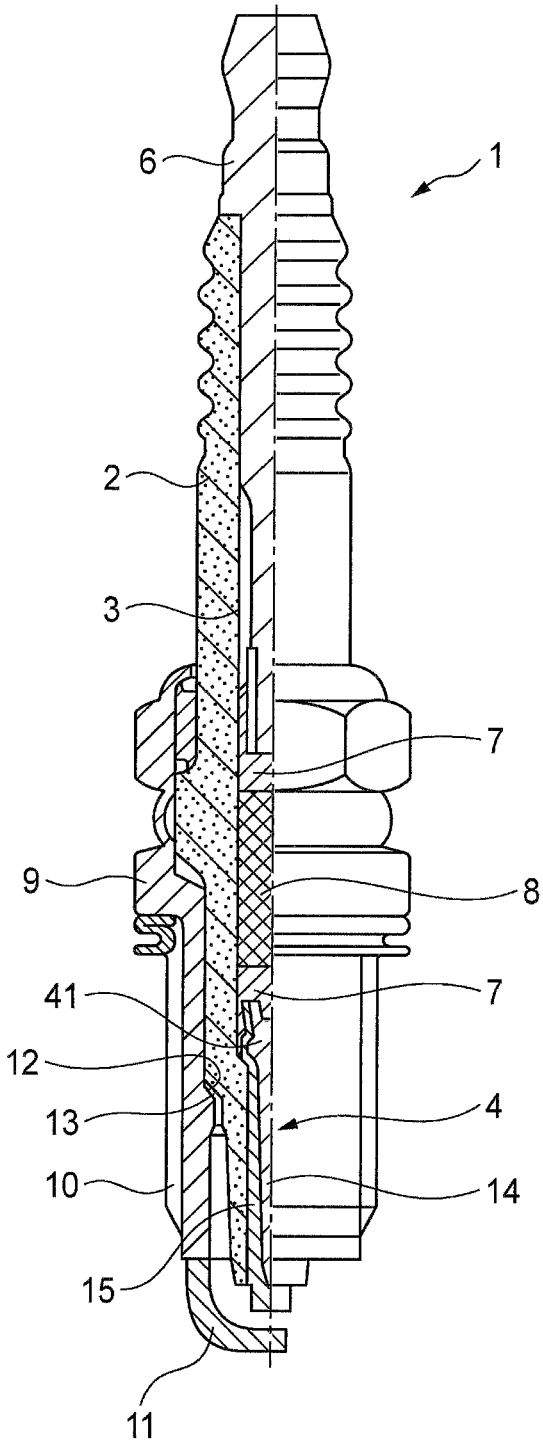
FIG. 1 is a cross-sectional view of an example of a spark plug.

FIG. 1 is a cross-sectional view of an example of a spark plug. As shown in FIG. 1, the spark plug 1 includes an insulator 2 having an axial hole 3; a center electrode 4 which has a guard and is held in the axial hole 3 at the front end thereof; a terminal electrode 6 and a resistor 8 which are inserted and held in the axial hole 3 at the rear end thereof so as to sandwich an electrically conductive glass sealing material 7; a metallic shell 9 in which the insulator 2 is fixed to a stepped portion 12 via a packing 13; and a ground electrode 11 provided at the front end of a threaded portion 10 of the metallic shell 9 seas to face the front end of the center electrode 4 held by the insulator 2.

In the present invention, the center electrode 4 includes a core 14 formed of a matrix metal in which carbon is dispersed, and an outer shell 15 which is formed of a nickel alloy and surrounds the core 14.

No particular limitation is imposed on the nickel alloy serving as the material of the outer shell, and the nickel alloy may be an Inconel (registered trademark, Special Metals Corporation) alloy or a high-Ni material (Ni≥96%).

The core material is a composite material containing a matrix metal in which carbon is dispersed. For example, carbon nanotube is a highly thermally conductive material exhibiting a thermal conductivity of 3,000 to 5,500 $W \cdot m^{-1} \cdot K^{-1}$ at room temperature, which is considerably higher than that of copper (i.e., 398 $W \cdot m^{-1} \cdot K^{-1}$). Carbon has a thermal expansion coefficient as low as, for example, 1.5 to $2 \times 10^{-6}$/K. Therefore, when carbon is employed in the core, the thermal expansion coefficient of the entire core can be lowered, and the difference in thermal expansion coefficient can be reduced between the core and the outer shell material (i.e., a nickel alloy).

The carbon employed in the present invention may be in the form of the aforementioned carbon nanotube, carbon powder, or carbon fiber. Particularly, in consideration of dispersibility or processability, there is preferably employed carbon nanotube having a mean length of 0.1 μm to 2,000 μm in the longitudinal direction (particularly preferably 2 μm to 300 μm), carbon powder having a mean particle size of 2 μm to 200 μm (particularly preferably 7 μm to 50 μm), or carbon fiber having a mean fiber length of 2 μm to 2,000 μm (particularly preferably 2 μm to 300 μm). In the case where any of the aforementioned carbon materials is employed, when the size or length thereof is smaller than the lower limit, the interface area between the matrix metal and carbon increases in the composite material, and thus segmentation occurs in the composite material, resulting in lowered ductility, or the effect of increasing strength is less likely to be attained.

Therefore, when the composite material is formed into an electrode, voids may be generated in the electrode. The reason why the lower limit of the carbon nanotube length is smaller than that of the particle size or the fiber length is that carbon nanotube, which assumes a tubular shape, exhibits high adhesion strength to the matrix metal of the composite material (anchor effect), and thus voids are less likely to be generated in the composite material. In the case where any of the aforementioned carbon materials is employed, when the size or length thereof is greater than the upper limit, the theoretical density of the composite material is reduced. Therefore, when the composite material is formed into an electrode, voids tend to remain in the electrode. The composite material containing a large number of voids exhibits poor processability.

The matrix metal employed is preferably copper, which exhibits high thermal conductivity. However, the matrix metal may be nickel or iron, which is less expensive than copper. Nickel or iron is advantageous in the aspect of the small difference in thermal expansion coefficient between nickel or iron and a nickel alloy serving as the outer shell material, but nickel or iron exhibits thermal conductivity lower than that of copper. However, even in the case where nickel or iron is employed, when carbon, which exhibits excellent thermal conductivity, is dispersed in the matrix metal, the entire core exhibits increased thermal conductivity. Copper, nickel, or iron may be employed alone as the matrix metal, or the matrix metal may be a mixture of these metals. Copper, nickel, or iron may be employed in the form of an alloy containing copper, nickel, or iron, respectively, as a main component (i.e., in the largest amount). The component which forms an alloy with copper, nickel, or iron may be, for example, chromium, zirconium, or silicon.

The carbon content of the composite material is 80 vol. % or less, preferably 10 vol. % to 80 vol. %, particularly preferably 15 vol. % to 70 vol. %. The carbon content of the composite material is appropriately determined in consideration of the type of the matrix metal or carbon, the difference in thermal expansion coefficient between the composite material and a nickel alloy serving as the outer shell material, or the thermal conductivity of the composite material. The thermal expansion coefficient of the composite material is preferably $5\times10^{-6}$/K to $14\times10^{-6}$/K, particularly preferably $7\times10^{-6}$/K to $14\times10^{-6}$/K.

The carbon content or thermal expansion coefficient of the composite material may be determined through the following method.

(1) Carbon Content

The volume and weight of the composite material are measured, and only the matrix metal (e.g., copper) is dissolved in an acidic solution (e.g., sulfuric acid) by immersing the composite material in the solution. The weight of the matrix metal is calculated on the basis of the weight of the residue (i.e., carbon). The volume of the matrix metal is calculated on the basis of the weight and density of the matrix metal (e.g., density of copper: 8.93 g/cm$^3$). The carbon content of the composite material is calculated on the basis of the ratio of the volume of the matrix metal to that of the original composite material. When the matrix metal is an alloy, the composition of the alloy may be determined through quantitative analysis, and the density of an alloy having the same composition prepared through, for example, arc melting may be employed for calculation of the carbon content.

(2) Thermal Expansion Coefficient

The thermal expansion coefficient of the composite material is determined through the tensile load method in an inert gas atmosphere under heating to 200° C.

For production of the composite material, for example, powder of the matrix metal and carbon may be dry-mixed in the aforementioned proportions, and the resultant mixture may be subjected to powder compacting or sintering. Powder compacting is appropriately carried out by pressing at 100 MPa or higher. Sintering must be carried out at a temperature equal to or lower than the melting point of the matrix metal. When sintering is performed at ambient pressure, the sintering temperature is, for example, 90% of the melting point of the matrix metal. When sintering is performed under pressurized conditions (i.e., sintering is performed through HIP (e.g., 1,000 atm, 900° C.) or hot pressing), the sintering temperature can be lowered.

Alternatively, a calcined carbon product may be prepared, and the calcined product may be immersed in a molten matrix metal, to thereby impregnate the calcined product with the matrix metal.

Figure 2:
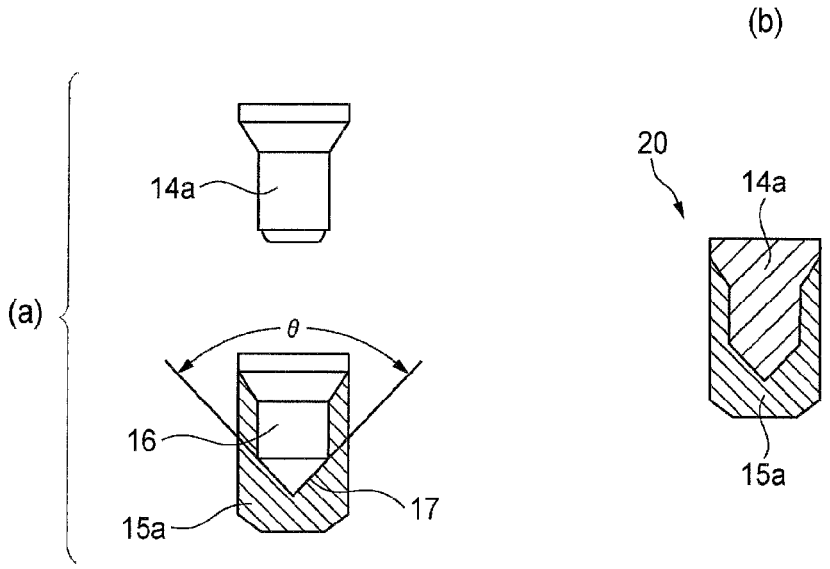
FIGS. 2(*a*) and 2(*b*) show a process for producing a work piece employed for production of a center electrode.

For production of the center electrode 4, firstly, as shown in FIG. 2(*a*), a columnar body 14*a* which is formed of the composite material and is to serve as the core 14 is placed in an interior portion 16 of a cup 15*a* which is formed of a nickel alloy and is to serve as the outer shell 15. As shown in FIG. 2(*a*), the bottom 17 of the interior portion 16 of the cup 15*a* may assume a fan-shaped cross section having a specific vertex angle θ. Alternatively, the bottom 17 may be flat. Subsequently, pressure is applied from above to the columnar body 14*a* placed in the cup 15*a*, to thereby form, as shown in FIG. 2(*b*), a work piece 20 including the cup 15*a* integrated with the columnar body 14*a*.

Figure 3:
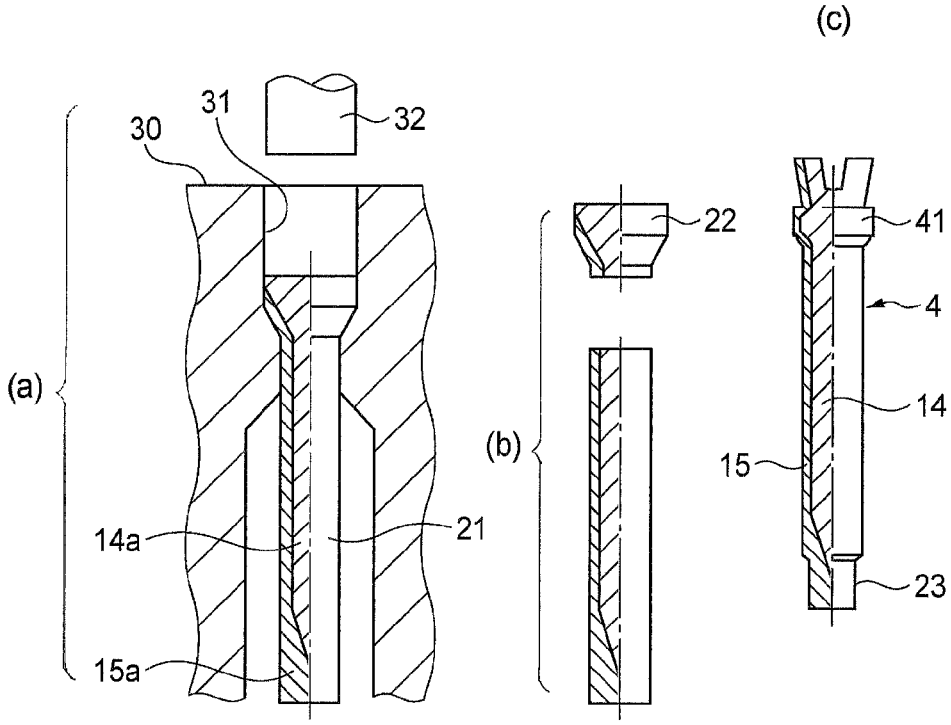
FIGS. 3(*a*) to 3(*c*) are hald-sectioned views showing a process for extruding the work piece employed for production of a center electrode.

Next, as shown in FIG. 3(*a*), the work piece 20 is inserted into an insert portion 31 of a die 30, and pressure is applied from above to the work piece 20 by means of a punch 32, to thereby form a small-diameter portion 21 having specific dimensions. Then, as shown in FIG. 3(*b*), a rear end portion 22 is removed through cutting, and then the remaining small-diameter portion 21 is further subjected to extrusion molding. Finally, as shown in FIG. 3(*c*), there is produced the center electrode 4 having, on the front end side, a small-diameter portion 23 having a diameter smaller than that of the small-diameter portion 21, and having, at the rear end, a locking portion 41 which protrudes in a guard-like shape so as to be locked on the stepped portion 12 of the axial hole 3 of the insulator 2. The center electrode 4 includes the outer shell 15 formed of a nickel alloy, and the core 14 formed of the composite material. The aforementioned extrusion molding may be carried out under cold conditions.

Through the aforementioned extrusion molding, the work piece 20 shown in FIG. 2(*b*) extends in the direction of the axis, and the columnar body 14*a* also extends accordingly. Therefore, in the composite material forming the columnar body 14*a* (i.e., the powder compact or sintered product formed of powder of the matrix metal and carbon, or the calcined carbon product impregnated with the matrix metal), carbon particles (or carbon nanotubes or fiber filaments) which have been linked together are separated from one another and dispersed in the matrix metal.

The present invention has been described above by taking, as an example, the method for producing the center electrode 4. Similar to the case of the center electrode 4, the ground electrode 11 may be configured so as to include the outer shell 15 formed of a nickel alloy, and the core 14 formed of the composite material. In such a case, the work piece 20 (including the cup 15*a* formed of a nickel alloy integrated with the columnar body 14*a* formed of the composite material) may be formed into a rod-shaped product through extrusion, and the thus-formed product may be bent so as to face the front end of the center electrode 4.

Figure 4:
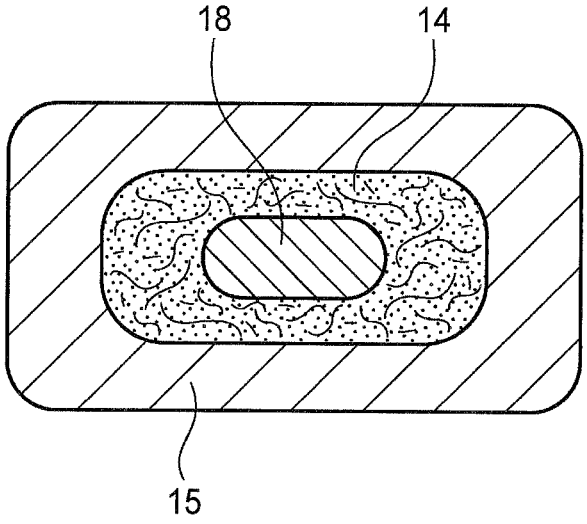
FIG. 4 is a schematic representation of another example of a ground electrode as viewed in cross section perpendicular to an axis.

As shown in FIG. 4 (as viewed in cross section perpendicular to the axis), the ground electrode 11 may have a three-layer structure including the core 14 formed of the composite material, the outer shell 15 formed of a nickel alloy, and a center member 18 formed of pure Ni and provided around the axis. Pure Ni plays a role in preventing deformation of the ground electrode 11; i.e., preventing bending of the ground electrode during production of the spark plug, or rising of the ground electrode after mounting of the spark plug on an engine. For formation of such a three-layer structure, as in the case of the work piece 20 shown in FIG. 2(*b*), a columnar body may be prepared by coating a core formed of pure Ni with the composite material, and the columnar body may be placed in the interior portion 16 of the cup 15*a*.

EXAMPLES

The present invention will next be further described with reference to the Examples and Comparative Examples, which should not be construed as limiting the invention thereto.

(Test 1)

Composite materials having different carbon contents (vol. %) were prepared from matrix metals and carbon (carbon powder or carbon fiber) shown in Table 1. The carbon content and thermal expansion coefficient of each composite material were determined through the methods described above in (1) and (2), respectively. The results are shown in Table 1.

As shown in FIGS. 2(*a*) and 2(*b*), each composite material was placed in a cup formed of a nickel alloy containing chromium (20 mass %), aluminum (1.5 mass %), iron (15 mass %), and nickel (balance), to thereby form a work piece. The work piece was formed into a center electrode and a ground electrode through extrusion molding. Each of the thus-formed center electrode and ground electrode was cut along its axis. The cut surface was polished and then observed under a metallographic microscope for determining formation of clearances at the boundary between the outer shell and the core, or generation of voids in the core. The results are shown in Table 1. In Table 1, "Large void" corresponds to voids having a diameter of 100 μm or more; "Small void" corresponds to voids having a diameter of less than 100 μm; "Small clearance" corresponds to clearances having a length of less than 100 μm; and "Large clearance" corresponds to clearances having a length of 100 μm or more.

A spark plug test sample was produced from the above-formed center electrode and ground electrode, and the spark plug test sample was attached to an engine (2,000 cc). The spark plug test sample was subjected to a cooling/heating cycle test. Specifically, the engine was operated at 5,000 rpm for one minute, and then idling was performed for one minute. This operation cycle was repeatedly carried out for 250 hours. After the test, the spark plug test sample was removed from the engine, and the gap between the center electrode and the ground electrode was measured by means of a projector, to thereby determine an increase in gap (i.e., the difference between the thus-measured gap and the initial gap).

The comprehensive evaluation of the spark plug test sample was determined according to the following criteria:

A: neither void nor interfacial clearance was generated;

B: small voids or small clearances were observed, but an increase in gap was 140 μm or less;

C: small voids or small clearances were generated, but an increase in gap was more than 140 μm and less than 200 μm; and D: an increase in gap was 200 μm or more, or large voids or large clearances were generated.

The results are shown in Table 1.

TABLE 1

| | | Carbon content | Matrix metal | Thermal expansion of composite material (×10^−6) | Durability test results: Increase in gap (μm) | Durability test results: Void or clearance | Durability test results: Comprehensive evaluation |
|---|---|---|---|---|---|---|---|
| 1 | Comp. Ex. | 0 | None | 13.0 | 238 | — | D |
| 2 | Comp. Ex. | 0 | Cu | 17.0 | 167 | Large void | D |
| 3 | Comp. Ex. | 0 | Ni | 13.0 | 201 | Small void | D |
| 4 | Comp. Ex. | 0 | Fe | 12.0 | 214 | Small void | D |
| 5 | Comp. Ex. | 5 | Cu | 16.1 | 152 | Small void | C |
| 6 | Comp. Ex. | 5 | Ni | 12.6 | 182 | Small void | C |
| 7 | Comp. Ex. | 5 | Fe | 11.5 | 197 | Small void | C |
| 8 | Comp. Ex. | 9 | Cu | 15.5 | 147 | Small void | C |
| 9 | Comp. Ex. | 9 | Ni | 12.0 | 161 | Small void | C |
| 10 | Comp. Ex. | 9 | Fe | 11.1 | 172 | Small void | C |
| 11 | Ex. | 10 | Cu | 15.3 | 115 | Small void | B |
| 12 | Ex. | 10 | Ni | 11.9 | 128 | Small void | B |
| 13 | Ex. | 10 | Fe | 10.8 | 137 | Small void | B |
| 14 | Ex. | 13 | Cu | 14.8 | 100 | Small void | B |
| 15 | Ex. | 15 | Cu | 14.4 | 82 | None | A |
| 16 | Ex. | 20 | Cu | 13.5 | 65 | None | A |
| 17 | Ex. | 23 | Cu | 12.9 | 51 | None | A |
| 18 | Ex. | 26 | Ni | 10.1 | 66 | None | A |
| 19 | Ex. | 30 | Cu | 11.8 | 41 | None | A |
| 20 | Ex. | 33 | Cu | 11.4 | 36 | None | A |
| 21 | Ex. | 36 | Fe | 7.9 | 59 | None | A |
| 22 | Ex. | 40 | Cu | 10.0 | 22 | None | A |
| 23 | Ex. | 43 | Cu | 9.3 | 41 | None | A |
| 24 | Ex. | 50 | Cu | 8.3 | 64 | None | A |
| 25 | Ex. | 56 | Cu | 7.5 | 83 | None | A |
| 26 | Ex. | 60 | Ni | 5.0 | 119 | None | A |
| 27 | Ex. | 65 | Cu | 5.6 | 97 | None | A |
| 28 | Ex. | 70 | Cu | 4.8 | 108 | None | A |
| 29 | Ex. | 73 | Fe | 3.0 | 121 | Small clearance | B |
| 30 | Ex. | 76 | Cu | 3.7 | 115 | Small clearance | B |
| 31 | Ex. | 80 | Cu | 3.0 | 120 | Small clearance | B |

TABLE 1-continued

| | | Carbon content | Matrix metal | Thermal expansion of composite material (×10^−6) | Durability test results: Increase in gap (μm) | Void or clearance | Comprehensive evaluation |
|---|---|---|---|---|---|---|---|
| 32 | Ex. | 80 | Ni | 2.3 | 133 | Small clearance | B |
| 33 | Ex. | 80 | Fe | 2.3 | 134 | Small clearance | B |
| 34 | Comp. Ex. | 81 | Cu | 2.4 | 146 | Large clearance | D |
| 35 | Comp. Ex. | 81 | Ni | 2.1 | 162 | Large clearance | D |
| 36 | Comp. Ex. | 81 | Fe | 2.0 | 179 | Large clearance | D |
| 37 | Comp. Ex. | 85 | Cu | 2.1 | — | — | D |
| 38 | Comp. Ex. | 85 | Ni | 1.6 | — | — | D |
| 39 | Comp. Ex. | 85 | Fe | 1.4 | — | — | D |

As shown in Table 1, in the case where the core is formed of a composite material having a carbon content of 10 vol. % to 80 vol. %, the amount of erosion is reduced (which is attributed to improved heat dissipation of the electrode), and an increase in gap is suppressed. Also, in this case, generation of voids is suppressed in the core, or formation of clearances is suppressed at the boundary between the outer shell and the core. In contrast, in the case where the core is formed of a composite material having a carbon content of less than 10 vol. %, even when copper is employed as a matrix metal, an increase in gap is observed, and voids or clearances are generated. Also, in the case where the core is formed of a composite material having a carbon content of more than 80 vol. %, an increase in gap is observed, and voids or clearances are generated. Particularly when the carbon content of a composite material was 85 vol. %, difficulty was encountered in forming the core into an electrode. Therefore, when a composite material having a carbon content of 85 vol. % was employed, neither measurement of an increase in gap, nor observation of a cut surface was carried out.

(Test 2)

As shown in Table 2, composite materials (carbon content: 40 vol. %) were prepared from matrix metals and carbon powders having different mean particle sizes or carbon fibers having different mean fiber lengths. The theoretical density of each composite material was determined. Table 2 shows the ratio of the actual density of the composite material to the theoretical density thereof (hereinafter the ratio will be referred to as "theoretical density ratio").

In a manner similar to that of test 1, each composite material was placed in a cup formed of a nickel alloy, and the resultant work piece was formed into a center electrode and a ground electrode. The processability of the work piece into the electrode was evaluated. The results are shown in Table 2. For evaluation of processability, each of the thus-formed center electrode and ground electrode was cut along its axis, and the cut surface was polished and then observed under a metallographic microscope. Processability was evaluated according to the following criteria in terms of the distance between the front end of the nickel electrode (outer shell) and the position of the composite material (target of the distance: 4 mm):

A: 4.5 mm or less;

B: 5 mm or less;

C: 5.5 mm or less; and

D: more than 5.5 mm.

Furthermore, the cut surface was observed under a metallographic microscope in a manner similar to that of test 1 for determining the presence or absence of voids in the core. In Table 2, "None" corresponds to the case of generation of no voids; and "Very small," "Small," or "Large" corresponds to the case of generation of voids having a diameter of less than 30 μm, 30 to 50 μm, or more than 50 μm, respectively.

TABLE 2

| | | Carbon content | Matrix metal | Carbon: Form | Carbon: Size | Composite material Theoretical density ratio | Processing of electrode material: Processability | Cut surface | Evaluation |
|---|---|---|---|---|---|---|---|---|---|
| 40 | Ex. | 40 | Cu | Particles | 1 | 99.4 | B | Void, Small | C |
| 41 | Ex. | 40 | Cu | | 2 | 99.5 | B | None | B |
| 42 | Ex. | 40 | Cu | | 7 | 99.4 | A | None | B |
| 43 | Ex. | 40 | Cu | | 15 | 99.5 | A | None | B |
| 44 | Ex. | 40 | Cu | | 50 | 99.0 | A | None | B |
| 45 | Ex. | 40 | Fe | | 100 | 98.1 | B | None | B |
| 46 | Ex. | 40 | Cu | | 150 | 95.2 | B | None | B |
| 47 | Ex. | 40 | Ni | | 200 | 92.4 | B | Void, Very small | C |
| 48 | Ex. | 40 | Cu | | 209 | 89.4 | C | Void, Small | C |
| 49 | Ex. | 40 | Cu | | 220 | 87.3 | C | Void, Small | C |
| 50 | Ex. | 40 | Cu | Fiber | 1 | 99.5 | B | Void, Small | C |
| 51 | Ex. | 40 | Cu | | 2 | 99.4 | A | None | B |
| 52 | Ex. | 40 | Cu | | 7 | 99.5 | A | None | B |
| 53 | Ex. | 40 | Cu | | 15 | 99.7 | A | None | B |
| 54 | Ex. | 40 | Cu | | 50 | 99.5 | A | None | B |
| 55 | Ex. | 40 | Fe | | 100 | 98.6 | A | None | B |
| 56 | Ex. | 40 | Cu | | 300 | 97.2 | A | None | B |
| 57 | Ex. | 40 | Cu | | 500 | 96.0 | B | None | B |
| 58 | Ex. | 40 | Cu | | 900 | 93.5 | B | None | B |
| 59 | Ex. | 40 | Cu | | 1300 | 92.6 | B | None | B |

TABLE 2-continued

| | Carbon content | Matrix metal | Carbon Form | Carbon Size | Composite material Theoretical density ratio | Processing of electrode material Processability | Processing of electrode material Cut surface | Evaluation |
|---|---|---|---|---|---|---|---|---|
| 60 Ex. | 40 | Ni | | 1600 | 91.9 | B | None | B |
| 61 Ex. | 40 | Cu | | 1800 | 91.3 | C | None | B |
| 62 Ex. | 40 | Cu | | 2000 | 90.1 | B | Void, Very small | B |
| 63 Ex. | 40 | Cu | | 2010 | 88.4 | C | Void, Small | C |
| 64 Ex. | 40 | Cu | | 2100 | 87.2 | C | Void, Small | C |

As shown in Table 2, as carbon size increases, theoretical density ratio decreases, processability is impaired, and large voids are likely to be generated. This tendency is pronounced particularly when the mean particle size of carbon powder exceeds 200 μm, or the mean fiber length of carbon fiber exceeds 2,000 μm.

Although the present invention has been described in detail with reference to specific embodiments, it will be apparent to those skilled in the art that a variety of modifications or changes may be made without departing from the spirit and scope of the invention.

The present application is based on Japanese Patent Application No. 2010-213830 filed on Sep. 24, 2010, which is incorporated herein by reference.

INDUSTRIAL APPLICABILITY

According to the present invention, there is provided a center electrode or ground electrode exhibiting favorable thermal conductivity and good heat dissipation, by virtue of the small difference in thermal expansion coefficient between an outer shell and a core. Therefore, a spark plug including the electrode exhibits excellent durability.

DESCRIPTION OF REFERENCE NUMERALS

1: spark plug
2: insulator
3: axial hole
4: center electrode
6: terminal electrode
7: electrically conductive glass sealing material
8: resistor
9: metallic shell
10: threaded portion
11: ground electrode
12: stepped portion
13: packing
14: core
15: outer shell
14*a*: columnar body
15*a*: cup
20: work

The invention claimed is:

1. A spark plug electrode for use as at least one of a center electrode and a ground electrode, the electrode-comprising:

a core formed of a composite material containing a matrix metal and carbon dispersed therein in an amount in a range of 10 vol. % to 80 vol. %; and an outer shell which surrounds at least a portion of the core and which is formed of nickel or a metal containing nickel as a main component.

2. The spark plug electrode according to claim 1, wherein the matrix metal is selected from the group consisting of copper, iron, nickel, and an alloy containing, as a main component, at least one of copper, iron, and nickel.

3. The spark plug electrode according to claim 2, wherein the carbon content of the composite material is 15 vol. % to 70 vol. %, and the composite material has a thermal expansion coefficient of $5\times10^{-6}$/K to $14\times10^{-6}$/K.

4. The spark plug electrode according to claim 2, wherein the carbon is at least one species selected from the group consisting of carbon powder, carbon fiber, and carbon nanotube.

5. The spark plug electrode according to claim 1, wherein the carbon content of the composite material is 15 vol. % to 70 vol. %, and the composite material has a thermal expansion coefficient of $5\times10^{-6}$/K to $14\times10^{-6}$/K.

6. The spark plug electrode according to claim 5, wherein the carbon is at least one species selected from the group consisting of carbon powder, carbon fiber, and carbon nanotube.

7. The spark plug electrode according to claim 1, wherein the carbon is at least one species selected from the group consisting of carbon powder, carbon fiber, and carbon nanotube.

8. The spark plug electrode according to claim 7, wherein the carbon powder has a mean particle size of 2 μm to 200 μm.

9. The spark plug electrode according to claim 7, wherein the carbon fiber has a mean fiber length of 2 μm to 2,000 μm.

10. The spark plug electrode according to claim 7, wherein a mean length of the carbon nanotube in a longitudinal direction is 0.1 μm to 2,000 μm.

11. A spark plug comprising:

at least one of the center electrode and the ground electrode according to claim 1;

an insulator having an axial hole extending in a direction of an axis;

a center electrode held in the axial hole;

a metallic shell provided around the insulator; and a ground electrode which is provided such that a proximal end portion of the ground electrode is bonded to the metallic shell, and a gap is formed between a distal end portion of the ground electrode and a front end portion of the center electrode.

12. A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method comprising a step of producing at least one of the center electrode and the ground electrode, said step comprising the sub-steps of:

mixing a matrix metal with carbon so that the carbon content of the resultant mixture is adjusted to an amount in a range of 10 vol. % to 80 vol. %;

subjecting the mixture to powder compacting or sintering, to thereby form a core;

placing the core in a cup formed of nickel or a metal containing nickel as a main component; and subjecting the cup to cold working.

13. A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method comprising a step of producing at least one of the center electrode and the ground electrode, said step comprising the sub-steps of:

preparing a calcined carbon product;

impregnating the calcined carbon product with a molten matrix metal, to thereby form a core having a carbon content of 80 vol. % or less;

placing the core in a cup formed of nickel or a metal containing nickel as a main component; and subjecting the cup to cold working.

14. A method for producing at least one of a center electrode and a ground electrode for a spark plug, the method comprising the steps of:

mixing a matrix metal with carbon so that the carbon content of the resultant mixture is adjusted to an amount in a range of 10 vol. % to 80 vol. %;

subjecting the mixture to powder compacting or sintering, to thereby form a core;

placing the core in a cup formed of nickel or a metal containing nickel as a main component; and subjecting the cup to cold working so as to achieve a specific shape.

15. A method for producing at least one of a center electrode and a ground electrode for a spark plug, the method comprising the steps of:

preparing a calcined carbon product;

impregnating the calcined carbon product with a molten matrix metal, to thereby form a core having a carbon content of 80 vol. % or less;

placing the core in a cup formed of nickel or a metal containing nickel as a main component; and subjecting the cup to cold working so as to achieve a specific shape.

* * * * *